US006044687A

United States Patent [19]

Tseng

[11] Patent Number: 6,044,687

[45] Date of Patent: Apr. 4, 2000

[54] THREE-DIMENSIONAL SIMPLE FLEXIBLE MOULD FOR BENDING PIPES

[76] Inventor: Shao-Chien Tseng, No. 130, Sec. 2, Yang-Shin Rd., Yang-Mei 326 Taoyuan, Taiwan

[21] Appl. No.: 09/235,131

[22] Filed: Jan. 21, 1999

Related U.S. Application Data

[63] Continuation-in-part of application No. 09/209,530, Dec. 11, 1998.

[51] Int. Cl.[7] ..... B21D 9/01

[52] U.S. Cl. ..... 72/466; 72/466.2; 72/466.9; 72/149; 72/398

[58] Field of Search ..... 72/466.2, 466, 72/465.1, 466.8, 466.9, 398, 369, 150, 149, 154, 370.01; 425/392; 269/287; 267/167

[56] References Cited

U.S. PATENT DOCUMENTS

| | | | |
|---|---|---|---|
| 174,609 | 3/1876 | Wright | 72/466.2 |
| 279,573 | 6/1883 | Leaycraft | 72/466 |
| 2,963,068 | 12/1960 | Chiappe | 72/466 |
| 5,272,905 | 12/1993 | Parlow | 72/466 |
| 5,323,631 | 6/1994 | Weykamp | 72/466 |

*Primary Examiner*—Daniel C. Crane
*Attorney, Agent, or Firm*—Pro-Techtor International Services

[57] ABSTRACT

A three-dimensional simple flexible mould for bending pipes comprised of a plurality of arciform or half-circled spring elements, pins and chucking rings for being a protecting mould in a three-dimensional pipe bending process. The two ends of every spring element have two lapping portions with a hole both or respectively with a hole and a snap mouth or with a snap mouth both for receiving two pins therein. The spring elements are strung with pins to form a spiral spring typed flexible mould. Thereby, a straight pipe to be bent can be placed for being processed by a three-dimensional pipe bending process with a pipe bending machine. The spring elements can scatter the stress in bending. Thus can increase the bending strength of the pipe under bending moment. The bending process and detachment of the mould are simple and can improve the technique of processing in making artistic pipes.

2 Claims, 11 Drawing Sheets

THREE-DIMENSIONAL SIMPLE FLEXIBLE MOULD FOR BENDING PIPES

This is a Continuation-In-Part application of applicant's U.S. patent application Ser. No. 09/209,530, filed on Dec. 11, 1998.

BACKGROUND OF THE INVENTION

1. Field of the invention

The present invention is related to a three-dimensional simple flexible mould for bending pipes. When a pipe-bending machine is used to execute a three-dimensional pipe-bending (or bending forming) process on a metallic pipe, the flexible mould suits those metallic pipes with smaller flexibility and stiffness as well as with smaller diameters and thin walls. The flexible mould can effectively scatter the stress on a pipe wall during bending process, and therefore deformation of the pipe wall due to stress concentration can be prevented. The flexible mould can also be removed from a bent pipe conveniently after the three-dimensional bending forming process. Therefore, convenience of operation of the three-dimensional bending forming process can be ensured.

2. Description of the Prior Art

In the known pipe-bending processing techniques, pipe-bending machines are used to directly bend and rectify metallic pipes with larger stiffness. However, up to the present day, it is not that all metallic pipes are suitable for bending forming process. In fact, during bending forming, a pipe must have a certain thickness and stiffness in order to keep the capability of preventing from deformation.

The pipes are not suitable to be processed by bending forming directly with a pipe bending machine in the conventional techniques. This is because the material of which the metallic pipes are made has smaller stiffness than steel alloy. Therefore when in bending forming, the pipe wall is subjected to overly large concentration of stress, and the pipe wall is subjected to collapse.

And more, it is not that all steel alloy pipes are suitable for bending forming processes. In fact, a metallic pipe, no matter what material it is made of, will be more difficult to deal with in a bending forming process when its diameter is very small and its pipe wall is thinner. This is a technical impediment making difficulty of the bending forming process.

Based on the above stated reasons, mass production of three-dimensional metallic pipes in the industry has been being hard to put to practice by a simple way.

SUMMARY OF THE INVENTION

The present invention provides a three-dimensional simple flexible mould for bending pipes. The flexible mould has flexibility as of a spiral spring and provides convenience in assembling and detaching itself, thereby it can be slipped over a metallic straight pipe to be bending formed. When in bending forming the pipe, it can effectively scatter the bending moment in the pipe wall. This can avoid overly concentration of stress which can damage the pipe wall by deformation and collapsing. By this means, simplicity as well as convenience in the three-dimensional bending operation on the pipe can be increased.

The present invention is especially related to making the spiral spring typed flexible mould easier to be assembled and detached. So that when the metallic straight pipe is bending formed into a three-dimensional bended article, the flexible mould on the shaped bended pipe can still be detached in a simple way. Therefore, the flexible mould is recoverable.

In order to get the above object, the present invention is adapted to take a three-dimensional bending forming process with a pipe-bending machine available in the markets or with a multiple-axial oil pressure bending forming equipment with numerical control of a micro-computer. However, the main object is to complete a design for a practical and convenient flexible mould rather than to select a bending forming equipment.

The present invention will be apparent by the detailed description of the present invention in reference to the accompanying drawings.

DETAILED DESCRIPTION OF THE PREFERRED EMBODIMENT

Figure 1:
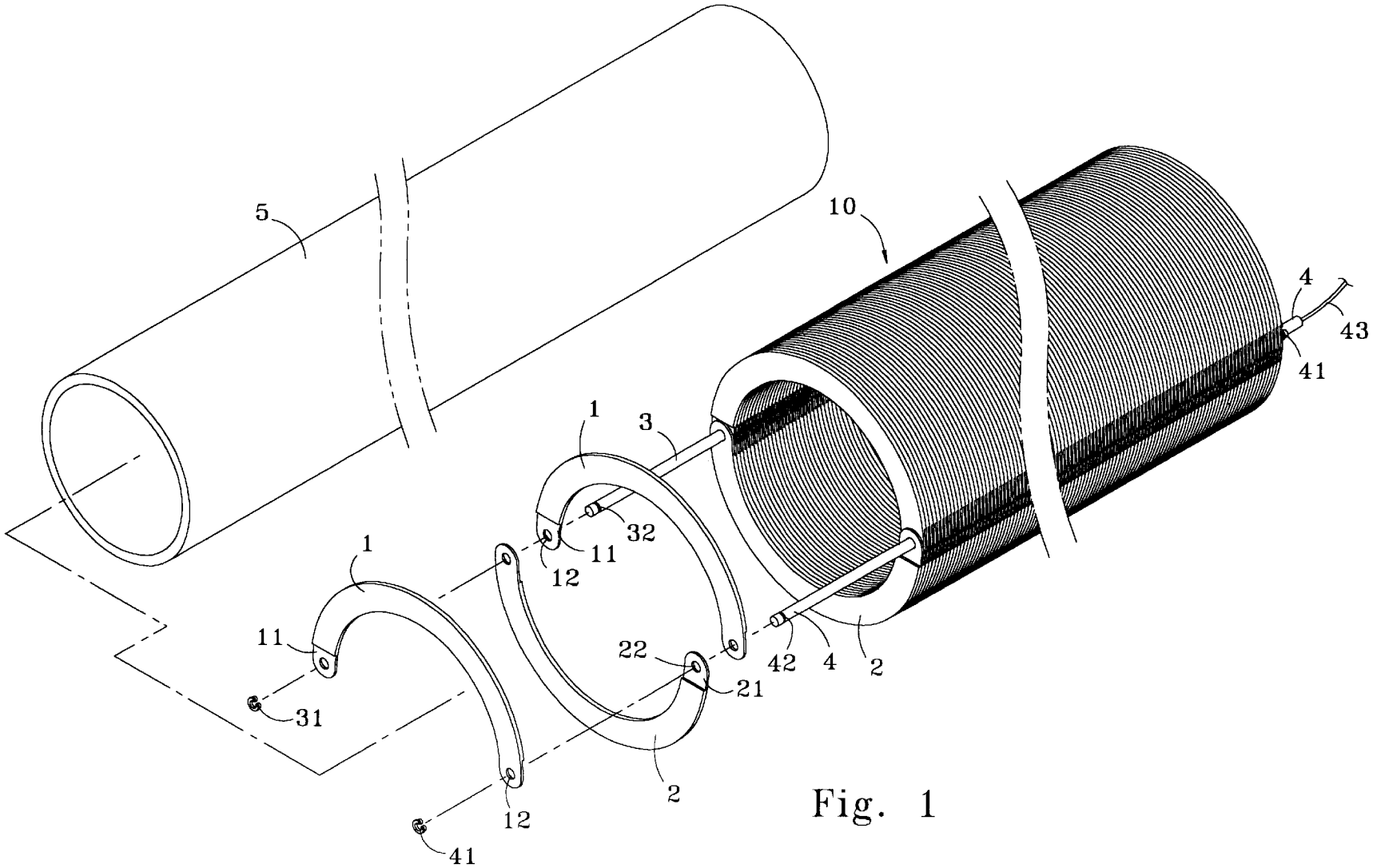
FIG. 1 is an analytic perspective view of the present invention.

Referring firstly to FIG. 1, the three-dimensional simple flexible mould 10 for bending pipes of the present invention is comprised of the simple elements of a plurality of arciform or half-circled spring elements 1 and 2, a plurality of pins 3 and 4 as well as chucking rings 31, 41. Among the pins 3 and 4, at least a pin 4 is provided on the tailing end thereof with a spring steel wire 43.

Figure 2:
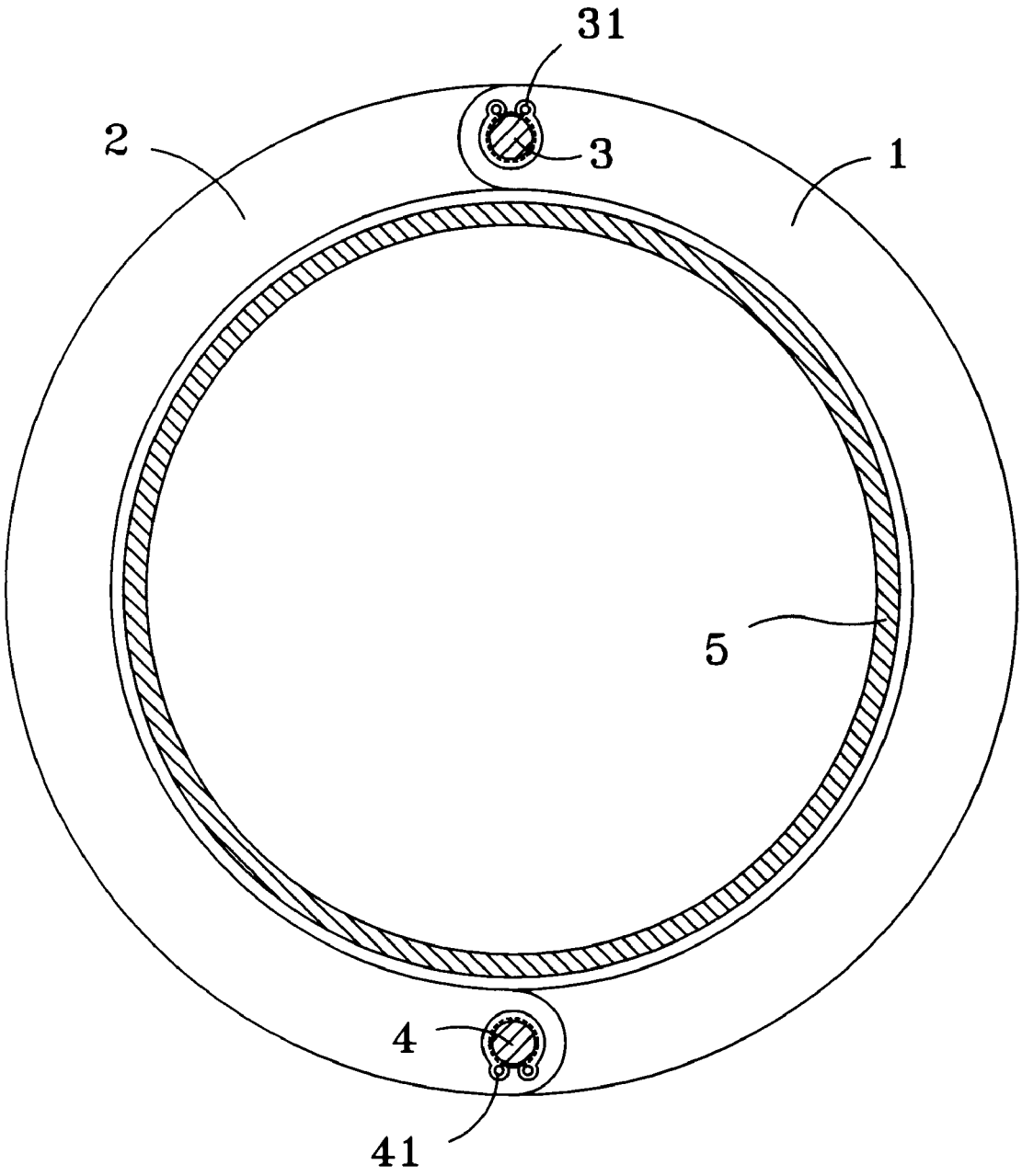
FIG. 2 is a partial sectional schematic side view showing assembling of the half-circled spring elements with the pins of the present invention.
Figure 3:
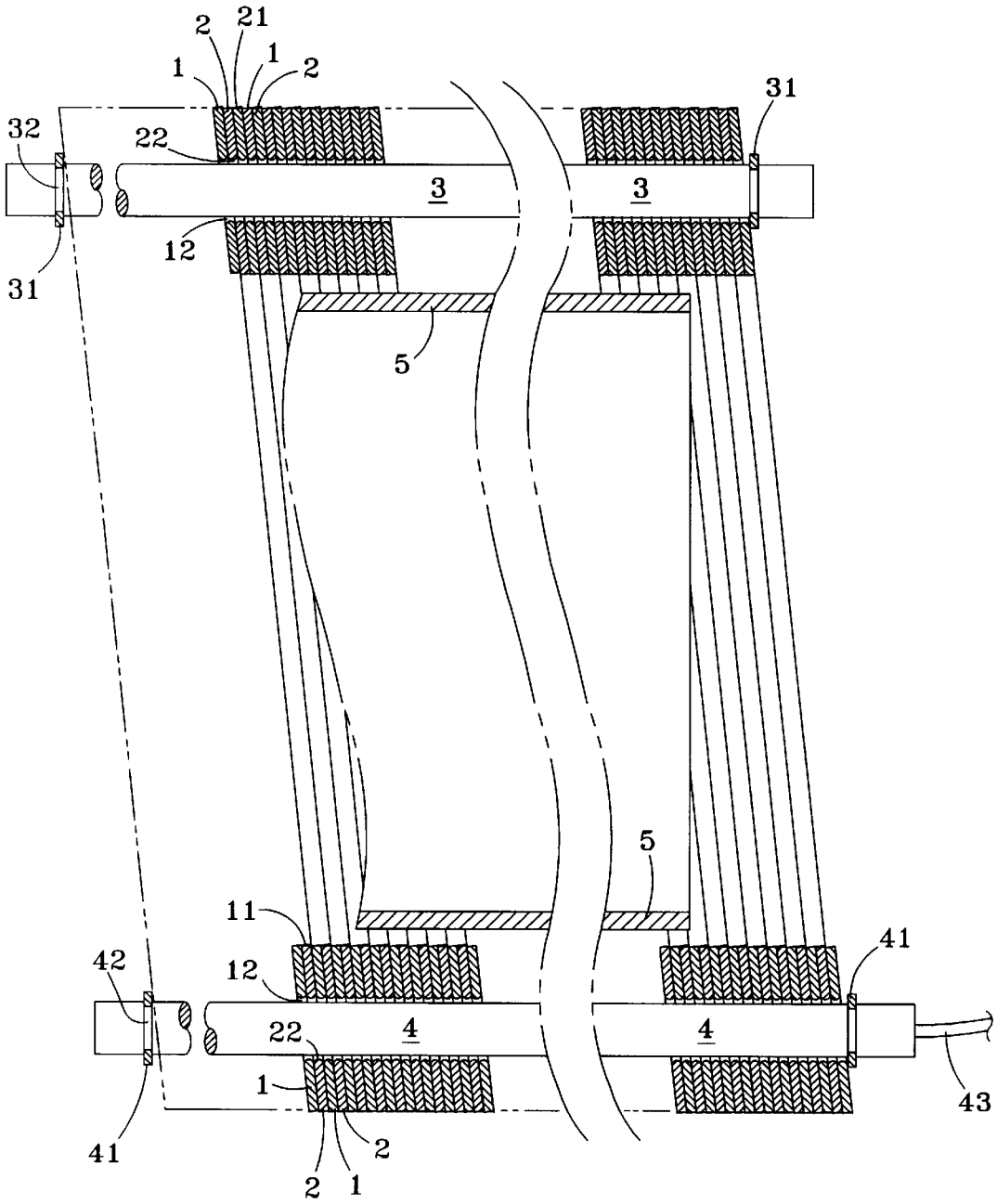
FIG. 3 is another sectional view showing a whole spiral typed spring of the present invention assembled by the pins.

Wherein, each half-circled spring element 1 or 2 is provided on its ends with lapping portions 11 (21) having holes 12 (22) therein. The holes 12, 22 are provided for insertion of the pins 3 and 4 therethrough, to help the half-circled spring elements 1 and 2 to be combined to form a circle. Wherein, the two lapping portions 11 of each half-circled spring element 1 are lapped respectively one over a lapping portion 21 of the half-circled spring element 2 at the left end thereof and the other over a lapping portion 21 of the half-circled spring element 2 at the right end thereof. After lapping, the pins 3 and 4 are inserted through the holes 12, 22 on the lapping portions 11, 21, such that the half-circled spring elements 1 and 2 are strung to form a spiral spring. The pins 3 and 4 are provided on both the open ends thereof with annular grooves 32, 42 respectively for engagement by the chucking rings 31, 41 to prevent the half-circled spring elements 1 and 2 from dropping. The spring steel wire 43 on the tailing end of the pin 4 is exposed. Thereby, a spiral spring like flexible mould 10 receiving a straight pipe 5 to be bent therein is constructed (referring to FIG. 2 and 3).

The thickness and diameter of the half-circled spring elements 1 and 2 used to construct the flexible mould 10 depends on the stiffness of the metallic pipe to be slipped thereover and bending formed. Generally, the thinner the thickness of the spring elements 1 and 2 is, the more favorable it is to scattering the bending moment acted on the pipe wall in bending forming. That is, the capability in preventing the pipe wall from abnormal deformation is better. The inner diameter of the spring elements 1 and 2 depends on the diameter of the pipe to be inserted. It is alright that the flexible mould 10 constructed loosely slipped over the pipe wall. The pins 3 and 4 are made of spring steel just as the spring elements 1 and 2, therefore they have excellent spring nature. They can keep excellent flexibility during a three-dimensional pipe-bending process. The spring steel wire 43 on the tailing end of the pin 4 can be firmly welded or screwed for securing. The spring steel wire 43 has excellent flexibility.

Figure 4:
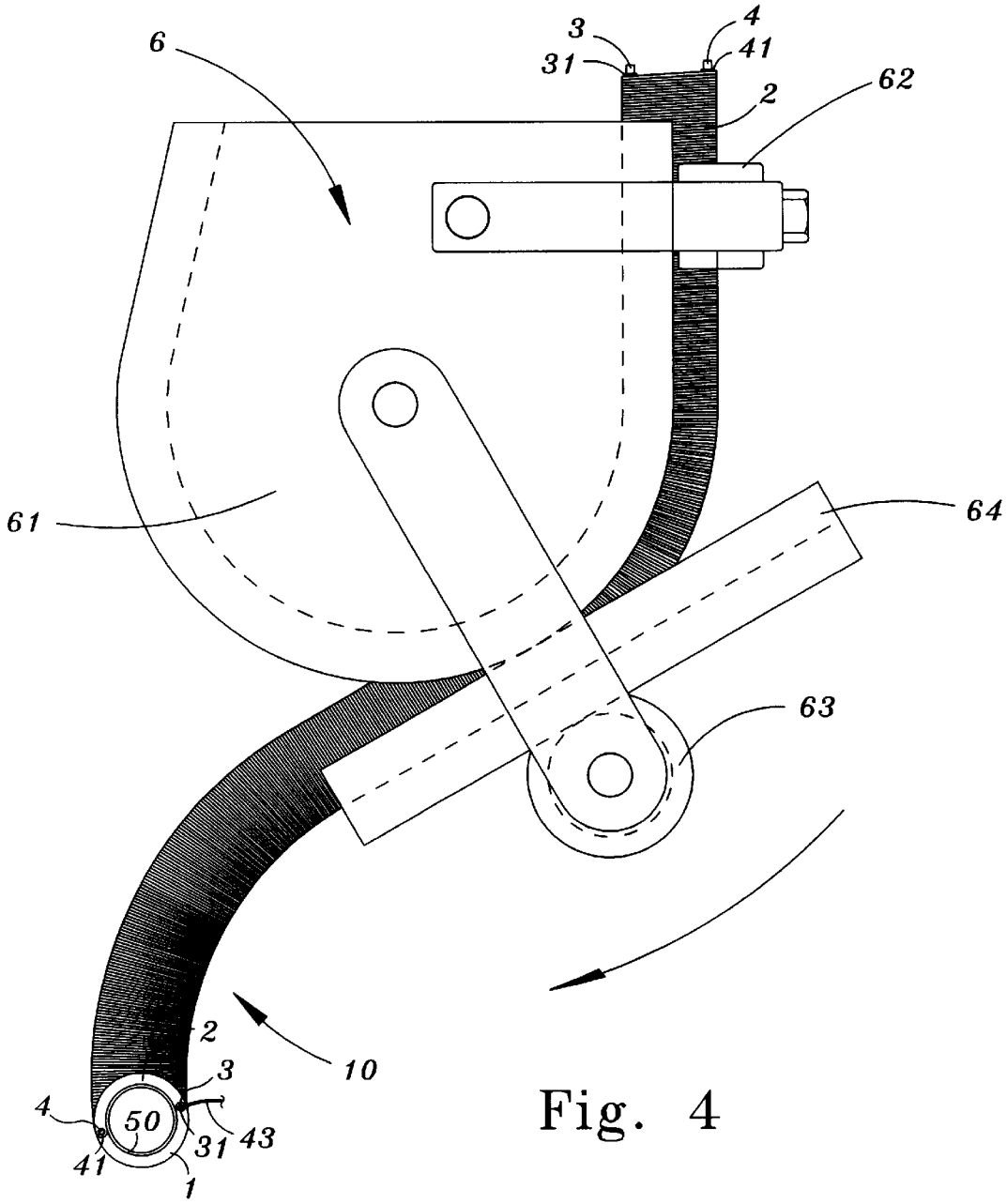
FIG. 4 is a schematic view showing bending forming operation with the flexible mould of the present invention on a pipe bending machine.

When it is to bending form the straight pipe 5, after the flexible mould 10 of the present invention is mounted thereover, they are placed as a whole on the bending seat 61 of a pipe bending machine 6. The flexible mould 10 and the straight pipe 5 can thus be under mechanical processing of swaying bending by means of a clamping member 62 and a bending bar 64 on a swaying arm having a wheel 63. Thus the straight pipe 5 can be bending formed into a three-dimensional bended pipe 50 (referring to FIG. 4).

Figure 5:
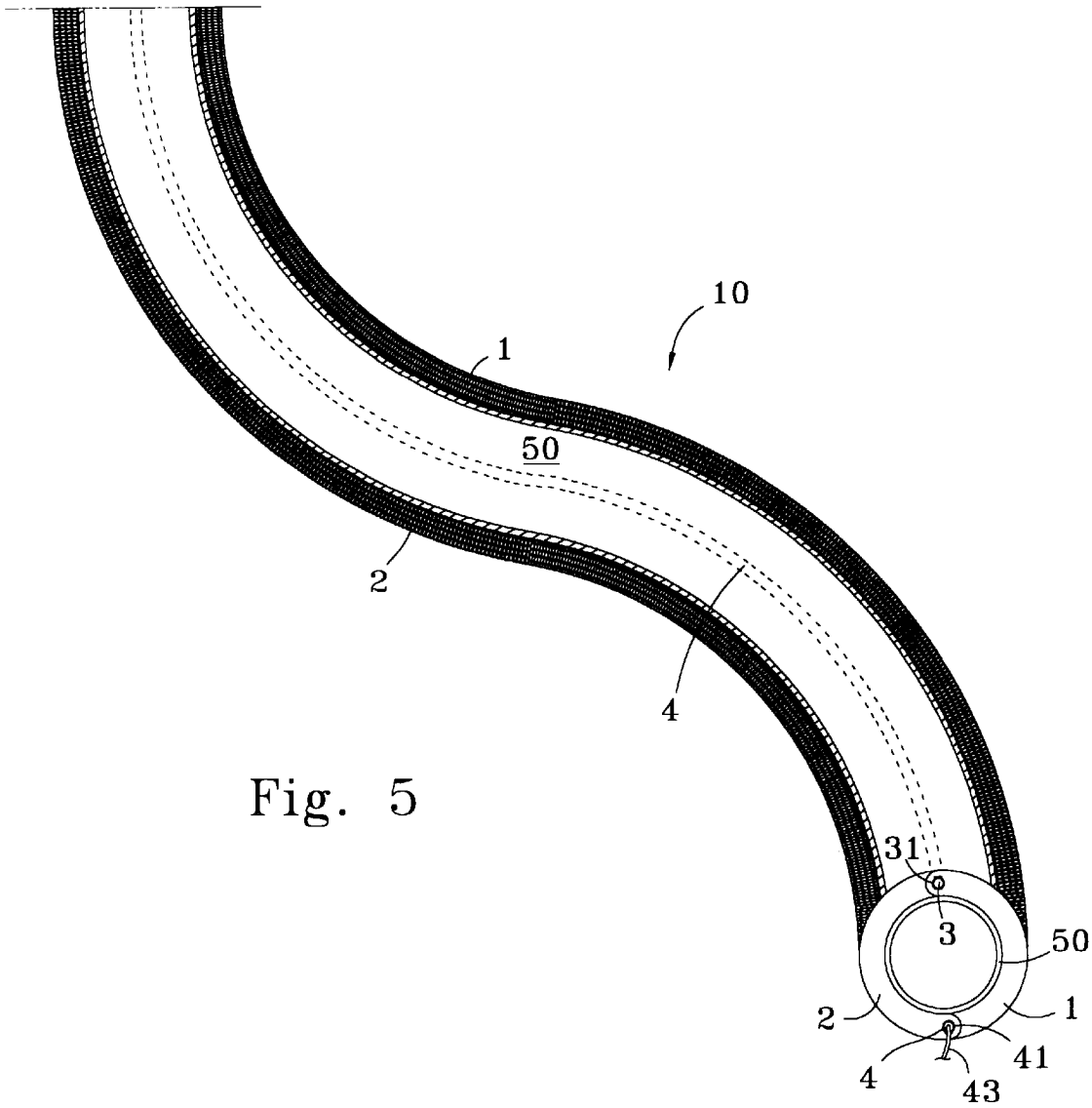
FIG. 5 is a partial sectional view showing distribution of the spring elements on the flexible mould over the pipe after bending forming with the present invention.

As shown in FIG. 5, the flexible mould 10 on the bended pipe 50 after processing by the three-dimensional pipe bending process includes the plural spring elements 1 and 2 and pins 3 and 4. If the plastic mould 10 has not been designed to be convenient for assembling and detaching, the bended pipe 50 formed is difficult to let remove of it. Practically, the present invention has been considered about this at the first. And by means of the spring elements 1 and 2 and the pins 3 and 4 removably connected to one another, the spring force stored during bending can be released by taking the chucking rings 41 off the pins 4 and letting free of the holes 12, 22 of the spring elements 1 and 2 for inserting the pins 4. The tailing ends of the pins 4 are connected to steel wires 43, thereby the spring elements 1 and 2 are not to be loosened and separated after the spring force stored is released. While the flexible mould 10 on the bended pipe 50 can be easily removed at this time to complete the operation of pipe bending.

Figure 6:
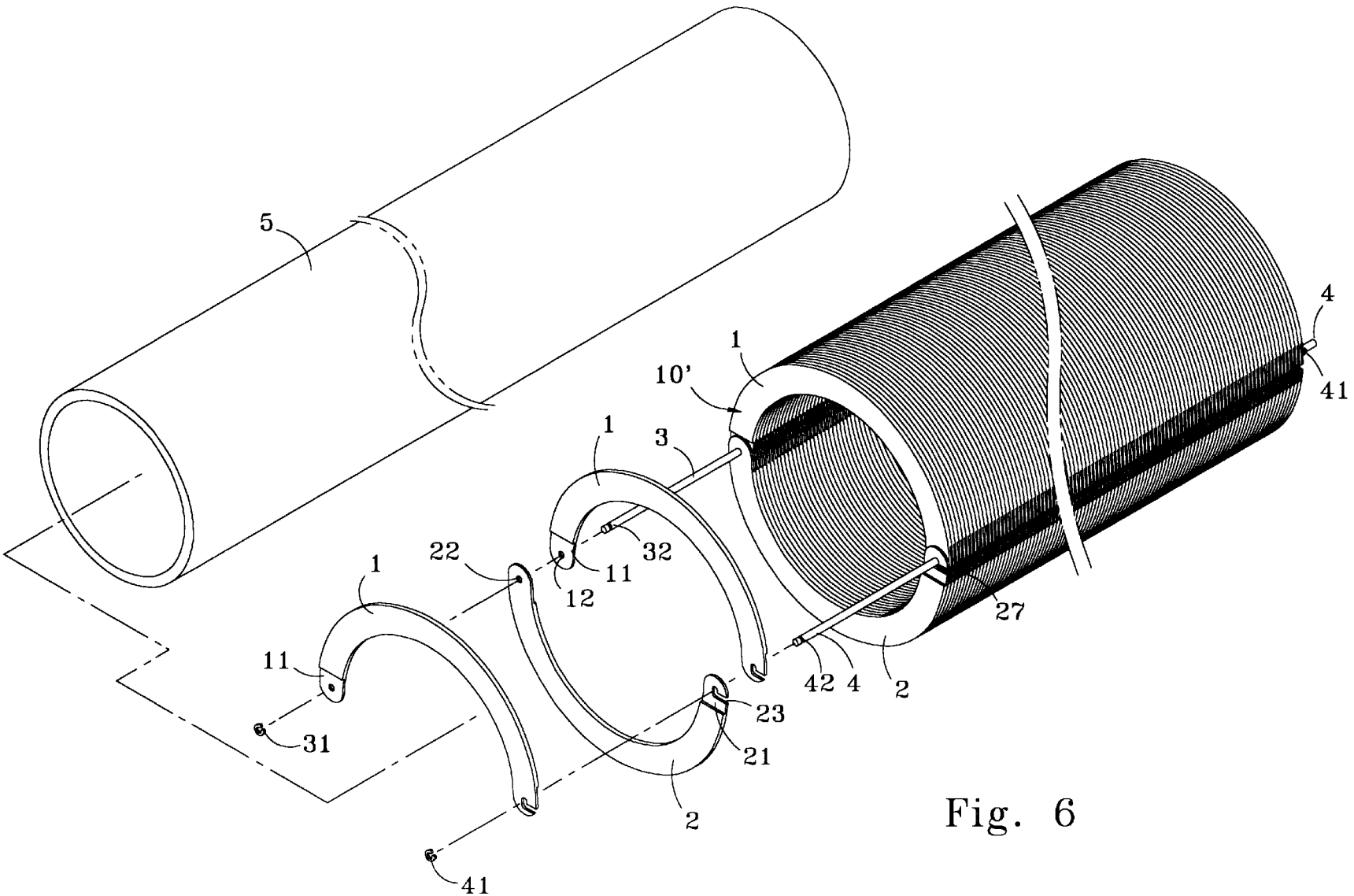
FIG. 6 is an analytic perspective view of another embodiment of the present invention.

Referring to FIG. 6, the drawing shows another embodiment of a spiral spring typed three-dimensional simple flexible mould 10' of the present invention for bending pipes. The flexible mould 10' is comprised also of the simple elements of a plurality of arciform or half-circled spring elements 1 and 2, a plurality of pins 3 and 4 as well as chucking rings 31, 41.

Figure 7:
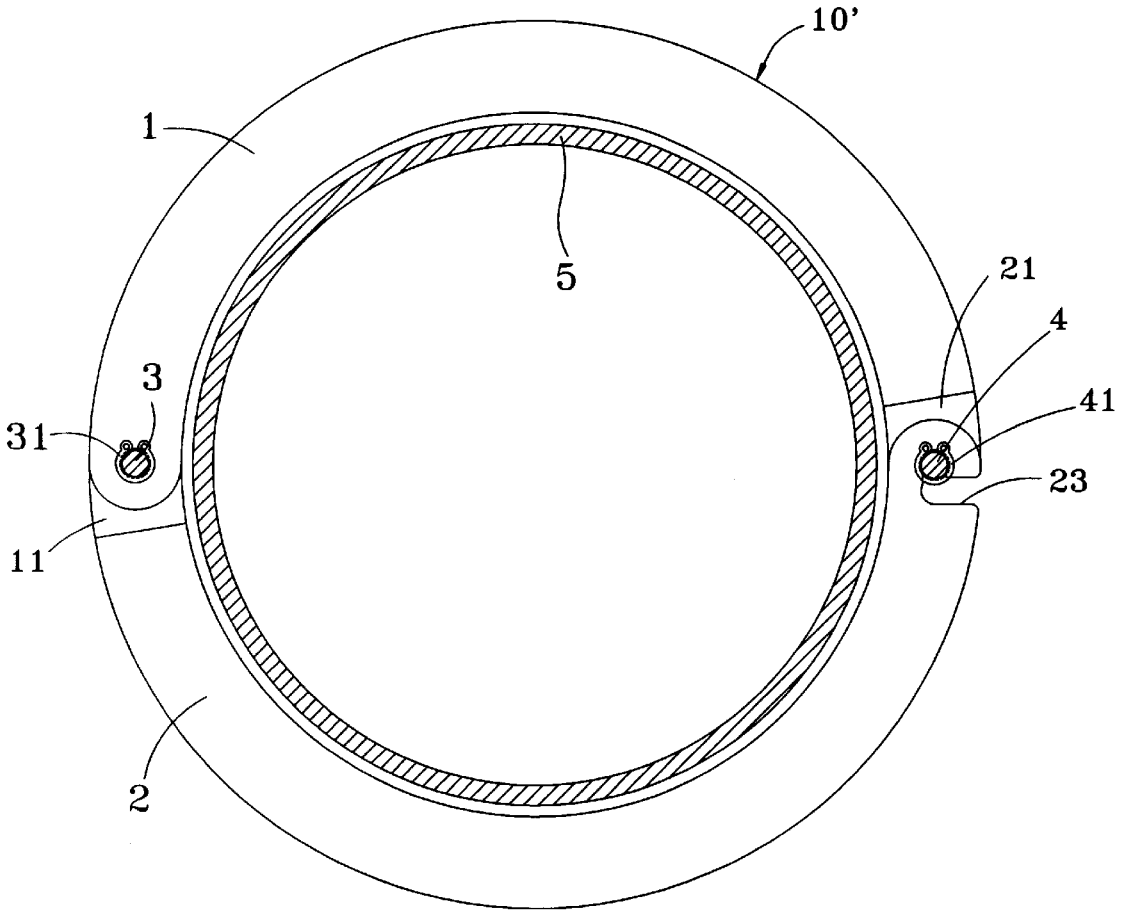
FIG. 7 is a partial sectional schematic side view showing assembling of the half-circled spring elements with the pins of the embodiment of the present invention shown in FIG. 6.
Figure 8:
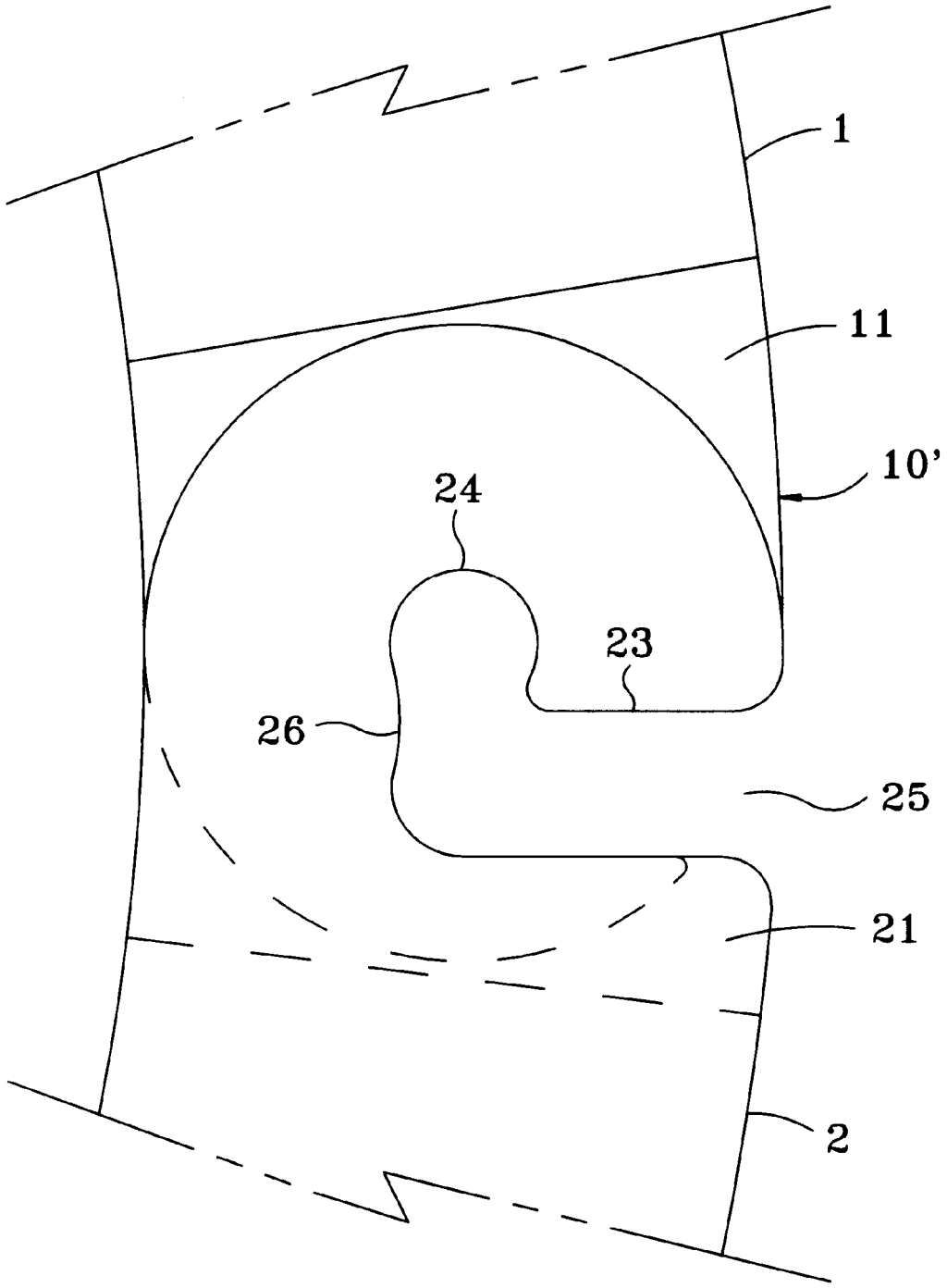
FIG. 8 is an enlarged schematic view showing a snap mouth on each half-circled spring element of the embodiment of the present invention shown in FIG. 6.
Figure 9:
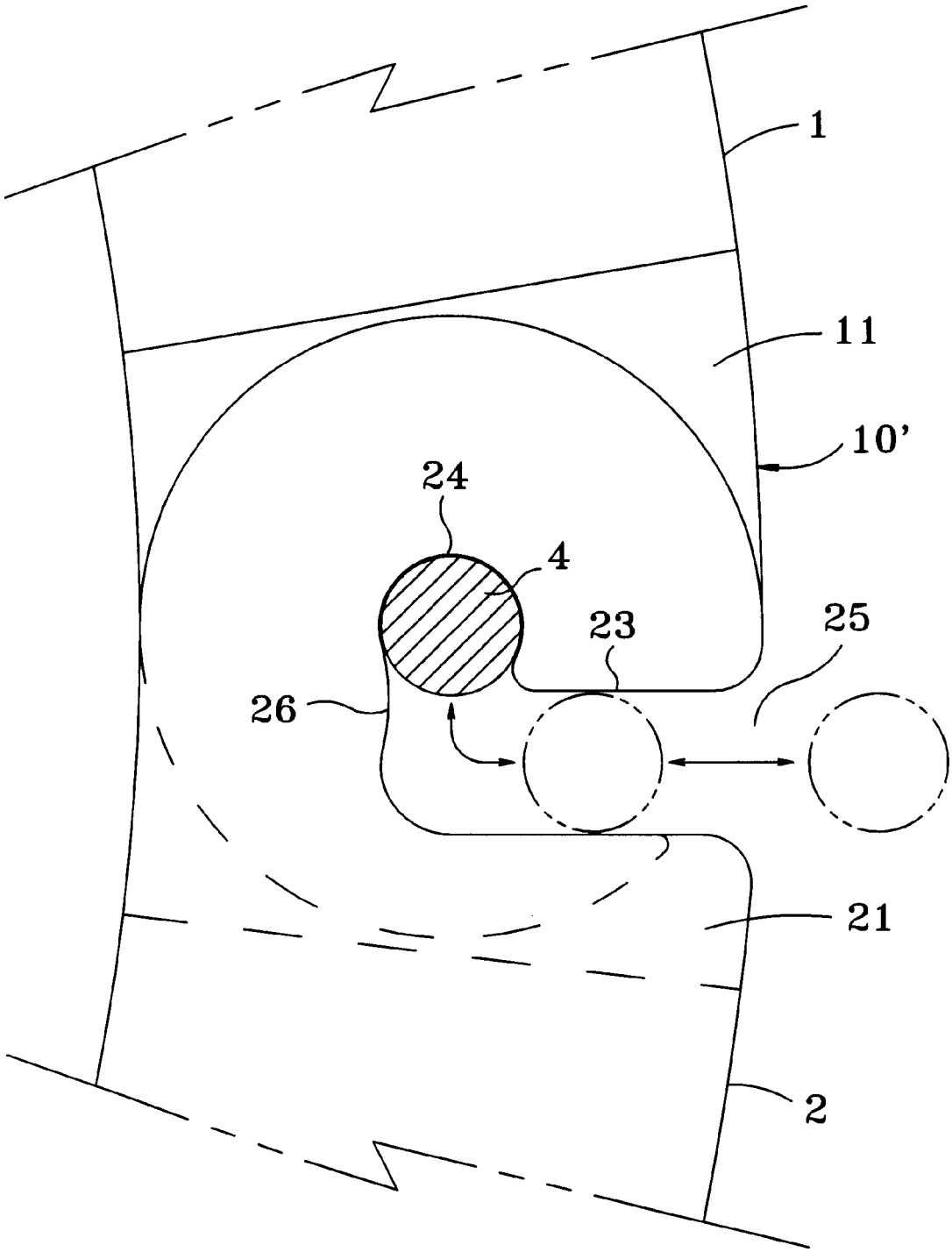
FIG. 9 is an enlarged schematic view showing assembling as well as detachment of a pin in/out of a snap mouth on each half-circled spring element of the embodiment of the present invention shown in FIG. 6.

Wherein, each half-circled spring element 1 or 2 is provided on its ends with lapping portions 11 (21). The lapping portion 11 has a hole 12 therein. The other lapping portion 21 is provided with a snap mouth 23 (referring to FIG. 6 and 7) which is formed on the innermost end 24 thereof an arc (as shown in FIG. 8) in order to receive a pin 4 to be pressed therein. An opening 25 of the snap mouth 23 opens to the exterior of the spiral spring typed flexible mould 10' (as shown in FIG. 8) in order to facilitate pressing in or moving out of the pin 4 relative to the snap mouth 23 (as shown in FIG. 9) without influencing a straight pipe 5 therein to be bending formed. The snap mouth 23 has near the innermost end 24 thereof a reduced neck portion 26 (as shown in FIG. 8). So that the pin 4 can be pressed through the reduced neck portion 26 after slipping into the snap mouth 23 and can be received in the innermost end 24 (as shown in FIG. 9).

As shown in FIG. 6, the hole 12 of the spring element 1 is aligned with the hole 22 of the spring element 2 for insertion therein the pin 3. While the snap mouth 23 of the spring element 1 is aligned with the snap mouth 23 of the spring element 2 for pressing therein the pin 4 to form a snap engaging channel 27.

Figure 10:
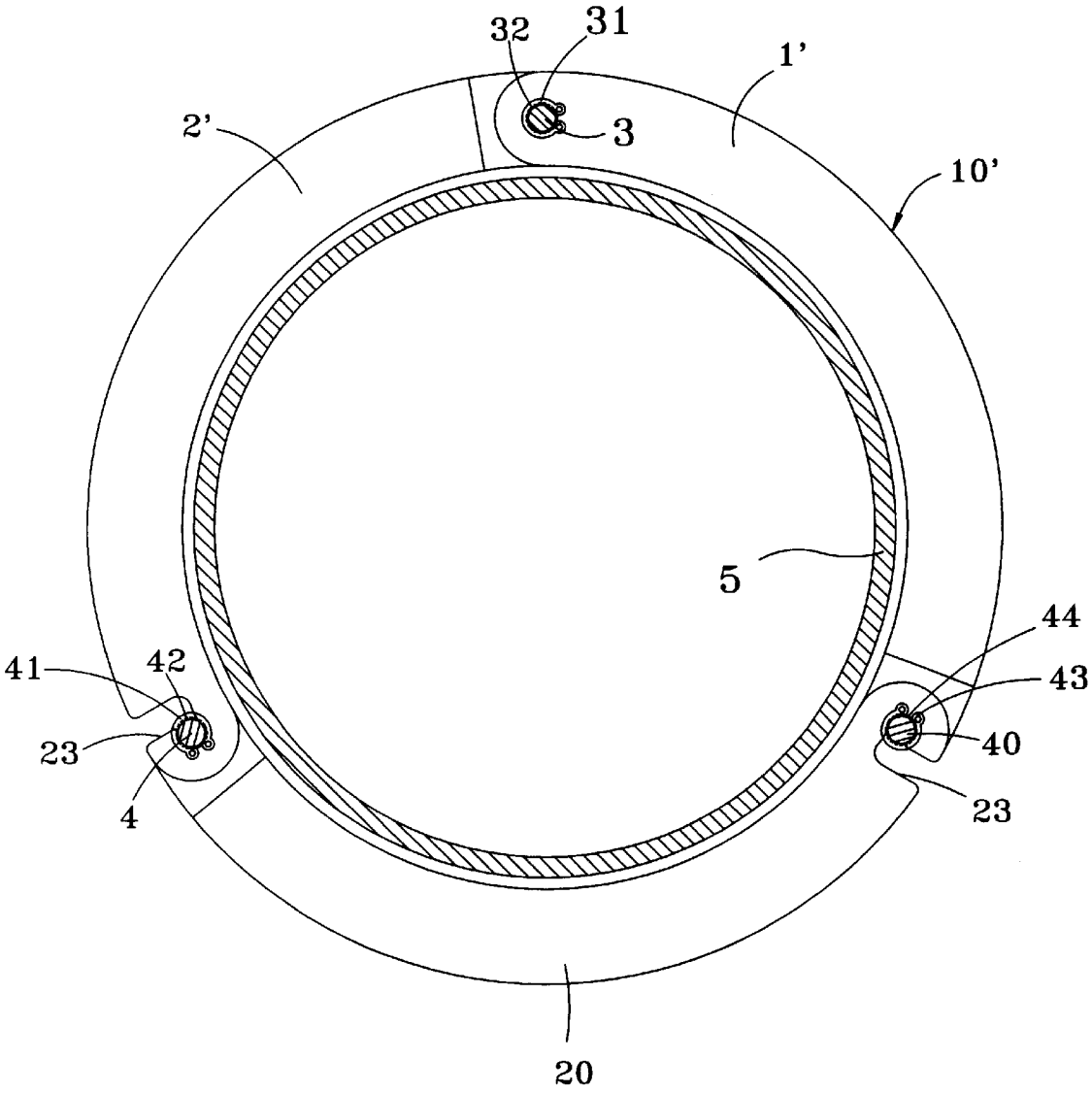
FIG. 10 is another schematic view showing assembling as well as detachment of a plurality of pins in/out of a plurality of snap mouths on a plurality of arciform spring elements to form a spiral typed spring of a further embodiment of the present invention.

In practice, the stated snap mouth 23 of the present invention can also be provided on both the lapping portions 11, 21 of a plurality of arciform spring elements 1, 2 to take the place of the hole 12 (22) on the lapping portions 11 (21) when each circle of the spiral spring typed flexible mould 10' is provided with three or more than three spring elements 1', 2', 20 etc. (as shown in FIG. 10). Wherein, two or more than two pins 4 and 40 are provided for pressing and snap engagement in a plurality of snap mouths 23. Especially, this can increase convenience in detachment of the flexible mould 10' by taking the two or more than two pins 4, 40 off the snap mouths 23 after the extremely complicated three-dimensional curvatures of a pipe is processed. Generally, the more the spring elements 1', 2', 20 and therefore the more the snap mouths 23 and the pins 4, 40 are used on the spiral spring typed flexible mould 10', the larger convenience of detachment of the flexible mould 10' from the complicated three-dimensional pipe can be.

By all means, the curvature and the number of the spring elements of the flexible mould 10' used must be that which can make a truly round spiral spring (as shown in FIG. 10). Besides, it is most important that the spring elements 1, 2 (or 1', 2' and 20) must be alternately connected one by one to form the spiral spring typed flexible mould 10'.

The above stated pins 3, 4 (or together with 40) are each provided on both ends thereof with an annular groove 32, 42 (or 44) respectively for engagement by the chucking rings 31, 41 (or 43) to prevent the spring elements 1 and 2 (or 1', 2' and 20) from dropping. Thereby, a flexible mould 10' with a straight pipe 5 to be bending formed therein is completed (as the one shown in FIG. 6).

Figure 11:
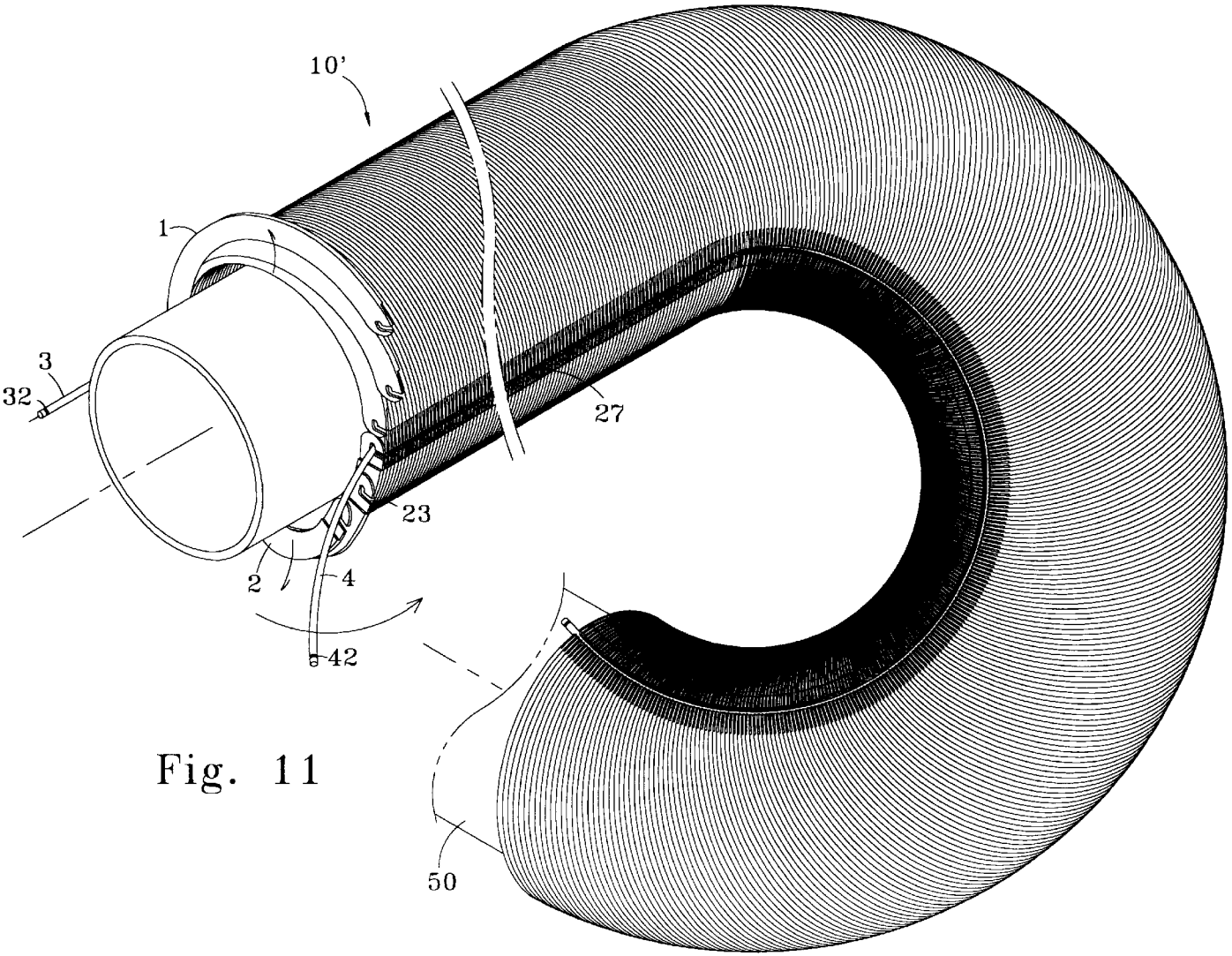
FIG. 11 is perspective view of the embodiment of the present invention shown in FIG. 6 or 10 showing detachment of the flexible mould from the pipe after the three-dimensional bending forming.

The flexible mould 10' on a bended pipe 50 after processing by the three-dimensional pipe bending process includes the plural spring elements 1 and 2 (or 1', 2' and 20) and pins 3 and 4 (or together with 40). The pin 4 (and 40) on the plastic mould 10' pressed into the snap mouth(s) 23 forming the snap engaging channel(s) 27 can be moved out (as shown in FIG. 11). The embodiments shown in FIG. 6 through 11 can get the object of easy detachment of the plastic mould 10' from the bended pipe 50 even more surely.

Having thus described my invention, what I claim as new and desire to be secured by Letters Patent of the United States are:

1. A three-dimensional spiral spring flexible mould adapted for bending pipes comprising:

in each circle of said spiral spring flexible mould at least two arciform spring elements, a plurality of pins and a plurality chucking rings, wherein, both ends of each of said spring elements are provided with a lapping portion; said pins are provided on both ends thereof with an annular groove for engagement by said chucking rings to prevent said spring elements from dropping, and wherein, said lapping portions on each of at least two of said spring elements are provided on a first end with a hole and on a second end with a snap mouth, all other said lapping portions include a snap mouth on each end, both said holes and said snap mouths are provided for insertion of said pins therethrough, thereby enabling a first one of said lapping portions on each of said spring elements to be lapped over one of said lapping portions of an adjacent one of said spring elements, such that said spring elements are joined to form a spiral spring flexible mould, each circle of said spiral spring flexible mould includes at least two spring elements, each of said snap mouths includes on an innermost end thereof an arc and has near said innermost end a reduced neck portion, an opening of said snap mouth opens to the exterior of said flexible mould in order to facilitate pressing one of said pins therein, said one of said pins passing through said neck portion to be received in said innermost end.

2. The three-dimensional spiral spring flexible mould for bending pipes as claimed in claim 1, wherein;

to connect said spring elements to said flexible mould, said snap mouths on said lapping portions of said spring elements are connected with other snap mouths on other spring elements in order to form at least one snap engaging channel by alignment of said snap mouths.

* * * * *